US009988834B2

(12) United States Patent
Sofianek et al.

(10) Patent No.: US 9,988,834 B2
(45) Date of Patent: Jun. 5, 2018

(54) CARRIER DEVICE FOR WINDOW BALANCE ASSEMBLY

(71) Applicant: Caldwell Manufacturing Company North America, LLC, Rochester, NY (US)

(72) Inventors: Jay Sofianek, Webster, NY (US); Richard S. DeNormand, Victor, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 259 days.

(21) Appl. No.: 13/828,497

(22) Filed: Mar. 14, 2013

(65) Prior Publication Data

US 2014/0208653 A1 Jul. 31, 2014

Related U.S. Application Data

(60) Provisional application No. 61/759,007, filed on Jan. 31, 2013.

(51) Int. Cl.
*E05D 13/00* (2006.01)
*E05D 15/22* (2006.01)

(52) U.S. Cl.
CPC ..... *E05D 13/1276* (2013.01); *E05D 15/22* (2013.01); *E05Y 2600/56* (2013.01); *E05Y 2800/344* (2013.01)

(58) Field of Classification Search
CPC ..... E05D 13/1276; E05D 15/48
USPC ..... 160/176, 181, 445, 447; 16/193–195
See application file for complete search history.

(56) References Cited

U.S. PATENT DOCUMENTS

| | | | | | |
|---|---|---|---|---|---|
| 4,570,382 | A * | 2/1986 | Suess | 49/430 |
| 4,958,462 | A * | 9/1990 | Cross | 49/181 |
| 5,353,548 | A * | 10/1994 | Westfall | 49/446 |
| 5,463,793 | A | 11/1995 | Westfall | |
| 5,632,118 | A * | 5/1997 | Stark | 49/181 |
| 5,661,927 | A * | 9/1997 | Polowinczak et al. | 49/447 |
| 7,587,787 | B2 * | 9/2009 | Pettit | 16/197 |

(Continued)

FOREIGN PATENT DOCUMENTS

WO WO 2011/100280 8/2011

OTHER PUBLICATIONS

"Caldwell Roller-Tilt Balance Systems" Caldwell [Brochure], Caldwell Manufacturing Company, Jan. 1999, p. 1-15.

(Continued)

*Primary Examiner* — Gregory J Strimbu
(74) *Attorney, Agent, or Firm* — Harness, Dickey & Pierce, P.L.C.

(57) ABSTRACT

A window balance assembly may include a spring member, a mounting bracket, and a carrier. The spring member may include a first portion and a second portion. The mounting bracket may engage the first portion of the spring member. The carrier may include an upper body portion supporting the second portion of the spring member and removably engaging the mounting bracket, a lower body portion rotatably supporting a cam, and an elongated central portion extending between the upper body portion and the lower body portion. The elongated central portion may be resiliently flexible to allow movement of the lower body portion relative to the upper body portion.

21 Claims, 11 Drawing Sheets

(56) References Cited

U.S. PATENT DOCUMENTS

| | | | | |
|---|---|---|---|---|
| 7,735,191 | B2 * | 6/2010 | Tuller | 16/193 |
| 8,561,260 | B2 * | 10/2013 | Baker et al. | 16/193 |
| 8,850,745 | B2 * | 10/2014 | Sofianek et al. | 49/447 |
| 2004/0163209 | A1 | 8/2004 | Pettit | |
| 2008/0178425 | A1 * | 7/2008 | Tuller | 16/197 |
| 2011/0239402 | A1 * | 10/2011 | Steen et al. | 16/197 |
| 2014/0000172 | A1 * | 1/2014 | Sofianek et al. | 49/430 |

OTHER PUBLICATIONS

"Inverted Balance Constant Force" Amesbury [Brochure], Amesbury Window Hardware, Sep. 2010, one page.

* cited by examiner

CARRIER DEVICE FOR WINDOW BALANCE ASSEMBLY

CROSS-REFERENCE TO RELATED APPLICATIONS

This application claims the benefit of U.S. Provisional Application No. 61/759,007, filed on Jan. 31, 2013. The entire disclosure of the above application is incorporated herein by reference.

FIELD

The present disclosure relates to a carrier device for a window balance assembly.

BACKGROUND

This section provides background information related to the present disclosure and is not necessarily prior art.

Modern window assemblies in residential, commercial and industrial buildings may include one or more window sashes that are movable within a window jamb. Window sashes that move vertically to open and close often include two or more window balance assemblies. The balance assemblies urge the window sash upward (i.e., toward an open position for a lower sash or toward a closed position for an upper sash) to assist a user in moving the window sash and to retain the window sash at a position selected by the user.

SUMMARY

This section provides a general summary of the disclosure, and is not a comprehensive disclosure of its full scope or all of its features.

In one form, the present disclosure provides a carrier for a window balance assembly that may include upper and lower body portions and an elongated central portion. The upper body portion may engage a spring member. The lower body portion may rotatably support a cam. The elongated central portion may extend between the upper body portion and the lower body portion. The elongated central portion may be resiliently flexible to allow movement of the lower body portion relative to the upper body portion.

In another form, the present disclosure provides a window balance assembly that may include a spring member, a mounting bracket, and a carrier. The spring member may include a first portion and a second portion. The mounting bracket may engage the first portion of the spring member. The carrier may include an upper body portion supporting the second portion of the spring member and removably engaging the mounting bracket, a lower body portion rotatably supporting a cam, and an elongated central portion extending between the upper body portion and the lower body portion. The elongated central portion may be resiliently flexible to allow movement of the lower body portion relative to the upper body portion.

In some embodiments, the carrier may be configured so that the window balance assembly is non-handed.

In some embodiments, the elongated central portion includes a pair of legs. In some embodiments, the legs may include an exterior face that is substantially flush with an exterior face of the upper body portion. In some embodiments, the legs include an exterior face that is angled relative to an exterior face of the upper body portion. In some embodiments, the legs may define a channel that is aligned with a slot in the cam and adapted to receive a portion of a pivot bar. In some embodiments, each of the legs may include an elongated reinforcement rib extending between the upper and lower body portions.

In some embodiments, the elongated central portion may include four elongated legs.

In some embodiments, the spring member includes a curl spring.

In some embodiments, the upper body portion, the lower body portion and the elongated central portion are integrally formed as a first unitary body. The carrier may also include a second unitary body including another upper body portion, another lower body portion and another elongated central portion. The first and second unitary bodies may cooperate to form a housing for the spring member and the cam.

In some embodiments, portions of the upper body portions of the first and second unitary bodies may be movable relative to each other in response to flexing of the elongated central portions.

In some embodiments, a position of the lower body portion of the first unitary body relative to the lower body portion of the second unitary body is unaffected by flexing of the elongated central portions.

In some embodiments, the elongated central portion may be resiliently flexible in a first direction (e.g., longitudinally) to allow movement of the lower body portion relative to the upper body portion. The elongated central portion may be substantially inflexible in a second direction (e.g., laterally) to restrict movement of the lower body portion relative to the upper body portion. In some embodiments, the elongated central portion may be resiliently twistable (e.g., about a longitudinal axis of the elongated central portion) to allow relative movement between the upper and lower body portions.

In another form, the present disclosure provides a method of installing a window balance assembly into a window jamb. The window balance assembly may include a carrier having a first portion supporting one of a spring member and a cam and a second portion supporting the other of the spring member and the cam. The method may include inserting the first portion into a jamb channel of the window jam through a cutout in the window jamb. The cutout may be disposed between upper and lower vertical ends of the window jamb. A central portion of the carrier that extends between the first and second portions may be flexed so that the second portion moves relative to the first portion. The first portion may be slid within the jamb channel toward one of the upper and lower vertical ends. The central portion of the carrier may be allowed to resiliently unflex to receive the central portion and the second portion into the jamb channel through the cutout.

In some embodiments, the second portion supports the cam and the first portion supports the spring member and releasably engages a mounting bracket engaging an end of the spring member. In some embodiments, the first portion supports the cam.

In some embodiments, the cutout may include a vertical height that is less than a vertical height of the window balance assembly. In some embodiments, the cutout may include a vertical height that is less than a vertical height of the carrier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
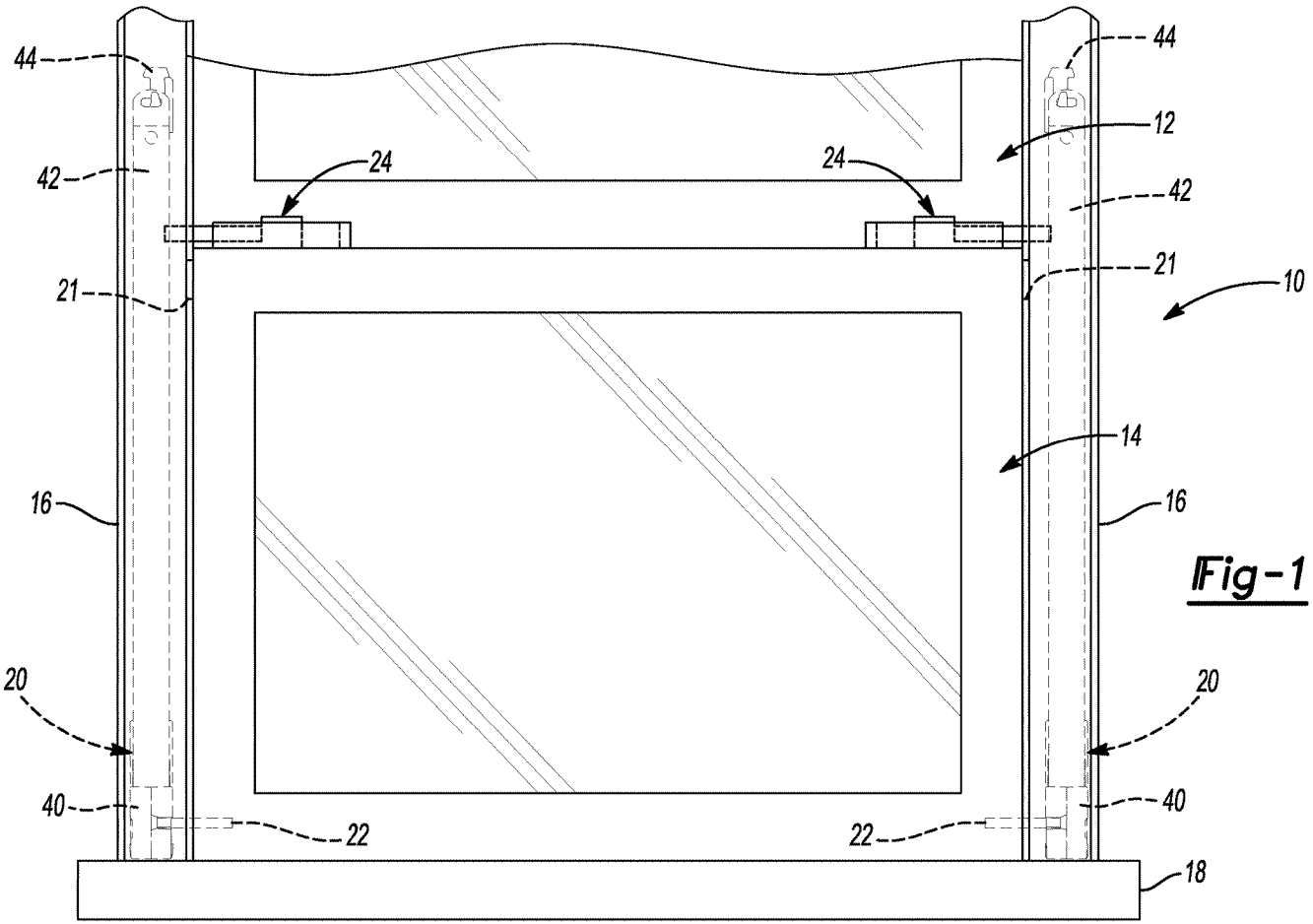
FIG. 1 is a partial front view of a window assembly including window balance assemblies according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a window assembly 10 is provided that may include an upper sash 12, a lower sash 14, a pair of window jambs 16, a window sill 18, a header (not shown) and two or more window balance assemblies or cartridges 20. In the particular embodiment illustrated in FIG. 1, the upper sash 12 is fixed relative to the window sill 18 and header (i.e., in a single hung window assembly). However, in some embodiments, the upper sash 12 may be movable relative to the window sill 18 and header between a raised or closed position and a lowered or open position (i.e., in a double hung window assembly). The lower sash 14 may be raised and lowered between open and closed positions and may be connected to the window balance assemblies 20 which assist a user in opening the lower sash 14 and maintain the lower sash 14 in a desired position relative to the window sill 18.

The lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20, as will be subsequently described. The tilt latch mechanisms 24 may extend laterally outward in opposing directions from an upper portion of the lower sash 14 and may selectively engage corresponding ones of the window jambs 16. The tilt latch mechanisms 24 may be selectively actuated to allow the lower sash 14 to pivot about the pivot bars 22 relative to the window jambs 16 to facilitate cleaning of an exterior side of the window assembly 10, for example.

It will be appreciated that in a double hung window assembly, the upper sash 12 may also be connected to two or more window balance assemblies to assist the user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Figure 6:
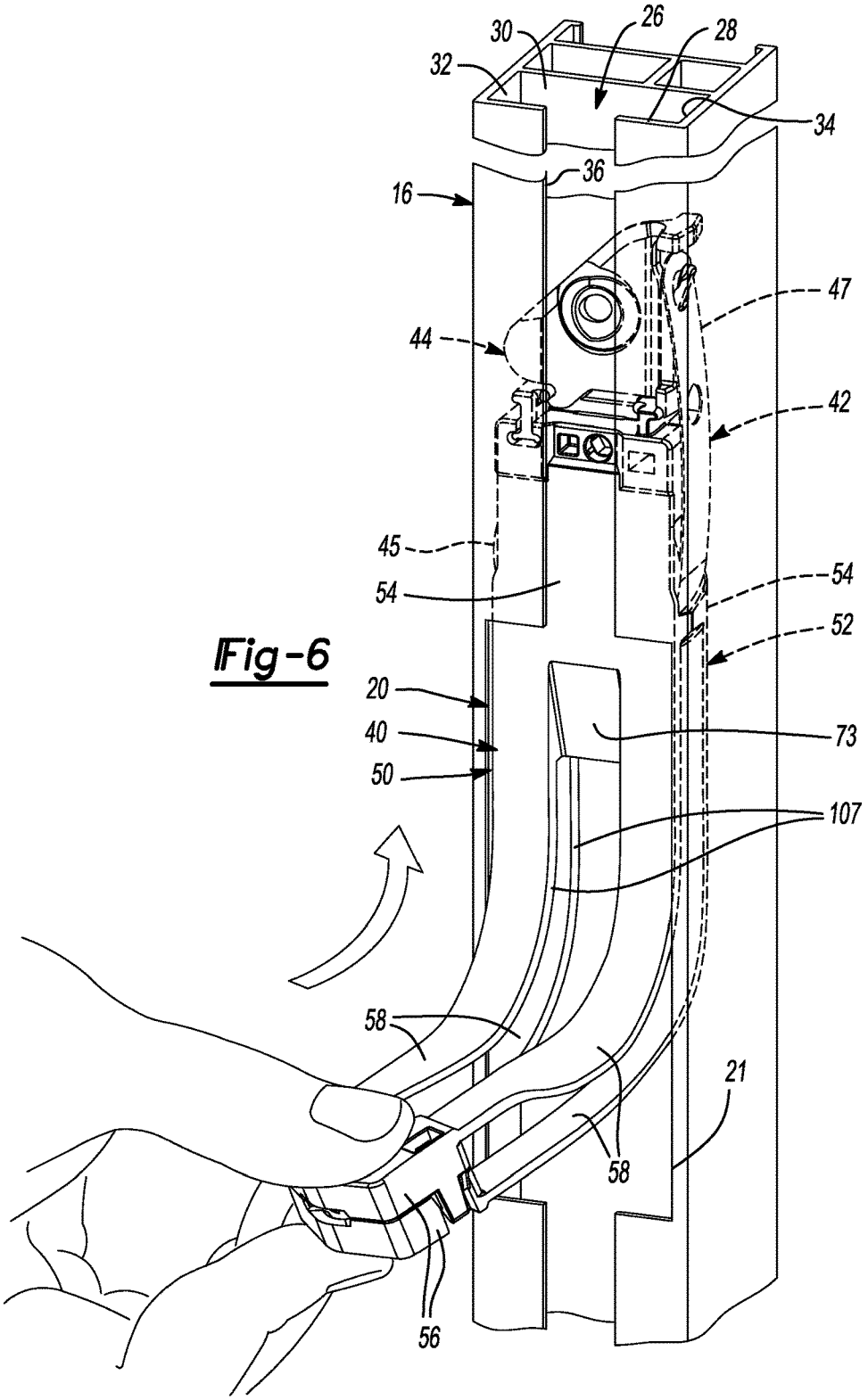
FIG. 6 is a perspective view of a portion of a window jamb and the window balance assembly being installed into a channel of the window jamb according to the principles of the present disclosure.
Figure 7:
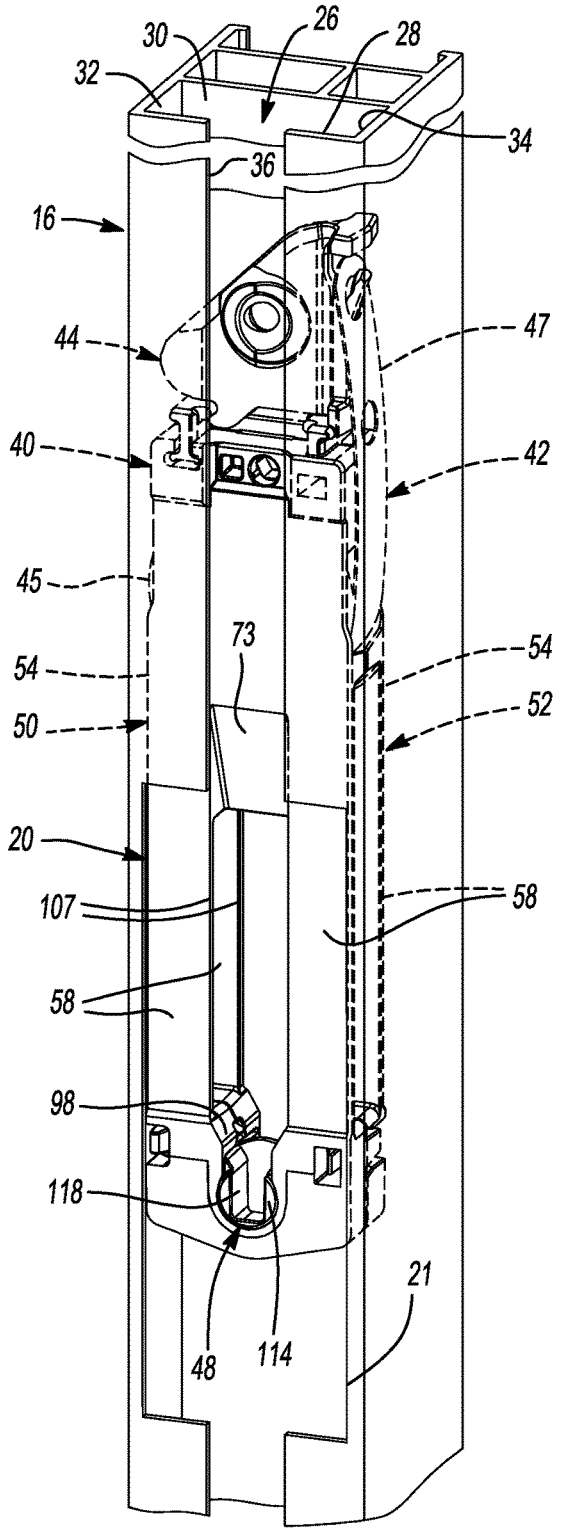
FIG. 7 is a perspective view of the portion of the window jamb and the window balance assembly received within the channel of the window jamb according to the principles of the present disclosure.

As shown in FIG. 6, each of the window jambs 16 may include a jamb channel 26 defined by a first wall 28, a second wall 30 opposite the first wall 28, and third and fourth walls 32, 34 disposed perpendicular to the first and second walls 28, 30. The first wall 28 may include a vertically extending slot 36 adjacent the lower sash 14. The window balance assembly 20 may be installed within the jamb channel 26. As shown in FIG. 1, the pivot bar 22 may extend through the slot 36 and into the jamb channel 26 to engage the window balance assembly 20. The tilt latch mechanism 24 may also selectively engage the slot 36 to lock the lower sash 14 in an upright position (FIG. 1).

Referring now to FIGS. 2-8, each window balance assembly 20 may include a carrier 40, a spring 42, and a bracket 44. The window balance assembly 20 may be modular, in that one or more of the carrier 40, spring 42 and bracket 44 shown in FIGS. 2-8 can be replaced with a different carrier, spring and/or bracket to suit a given application or set of specifications. It will also be appreciated that one or more of the carrier 40, spring 42 and bracket 44 could be incorporated into other configurations or types of window balance assemblies (e.g., moving-coil, fixed-coil, constant-force, non-constant-force, etc.). Furthermore, while the figures illustrate window balance assemblies having a single spring 42, in some embodiments, two or more springs 42 could be incorporated into a single window balance assembly to increase a spring capacity of the window balance assembly.

The window balance assembly 20 may be a movable-coil type window balance assembly, as the spring 42 and carrier 40 may be vertically movable with the lower sash 14 relative to the window jamb 16 and the bracket 44 may be fixed relative to the window jamb 16 when the window balance assembly 20 is fully installed. The carrier 40 (also referred to as a shoe) may engage the pivot bar 22, which in turn, may engage the lower sash 14. The carrier 40 may house a curled portion 45 of the spring 42. The bracket 44 may engage an uncurled end 47 of the spring 42 and may be fixed relative to the window jamb 16 when the window balance assembly 20 is fully installed within the window jamb 16. The spring 42 may resist being uncurled such that the spring 42 exerts an upward force on the carrier 40, thereby biasing the lower sash 14 upward toward the open position.

Figure 2:
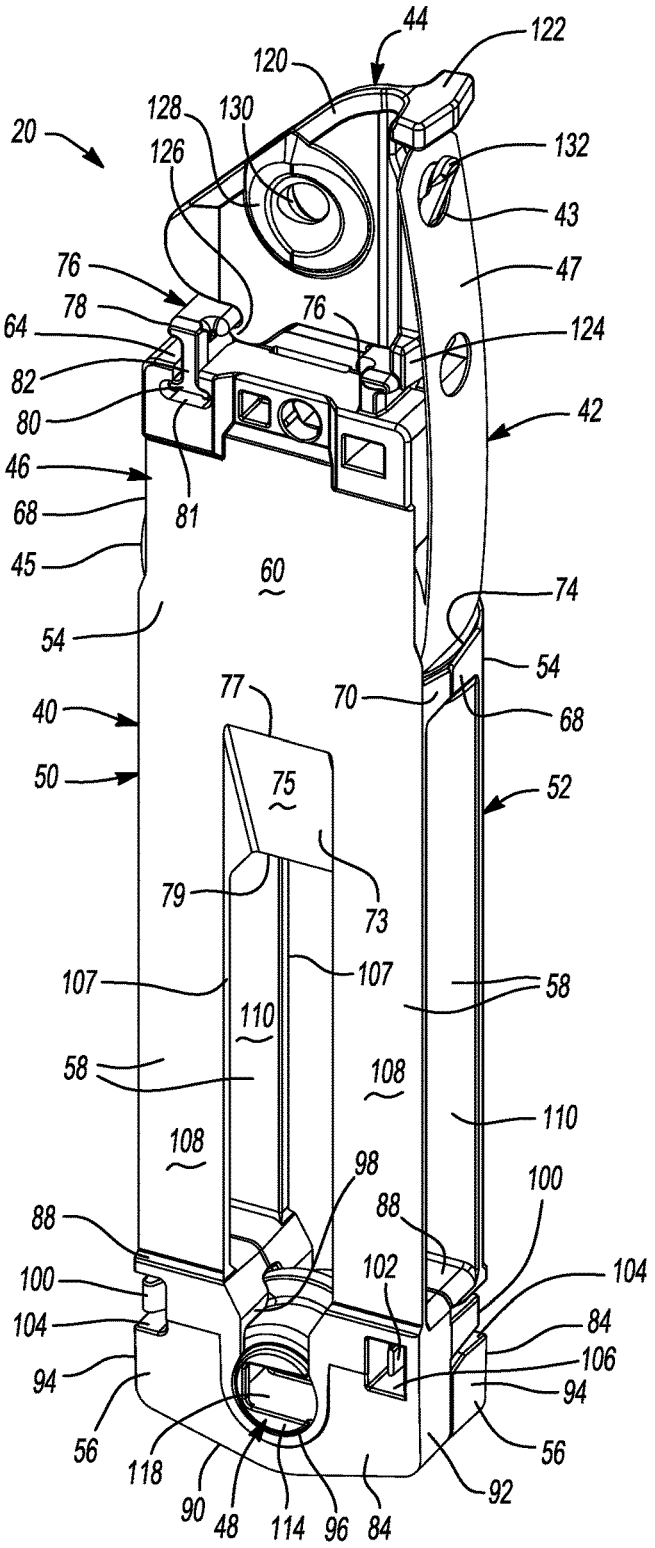
FIG. 2 is a perspective view of one of the window balance assemblies of FIG. 1.
Figure 3:
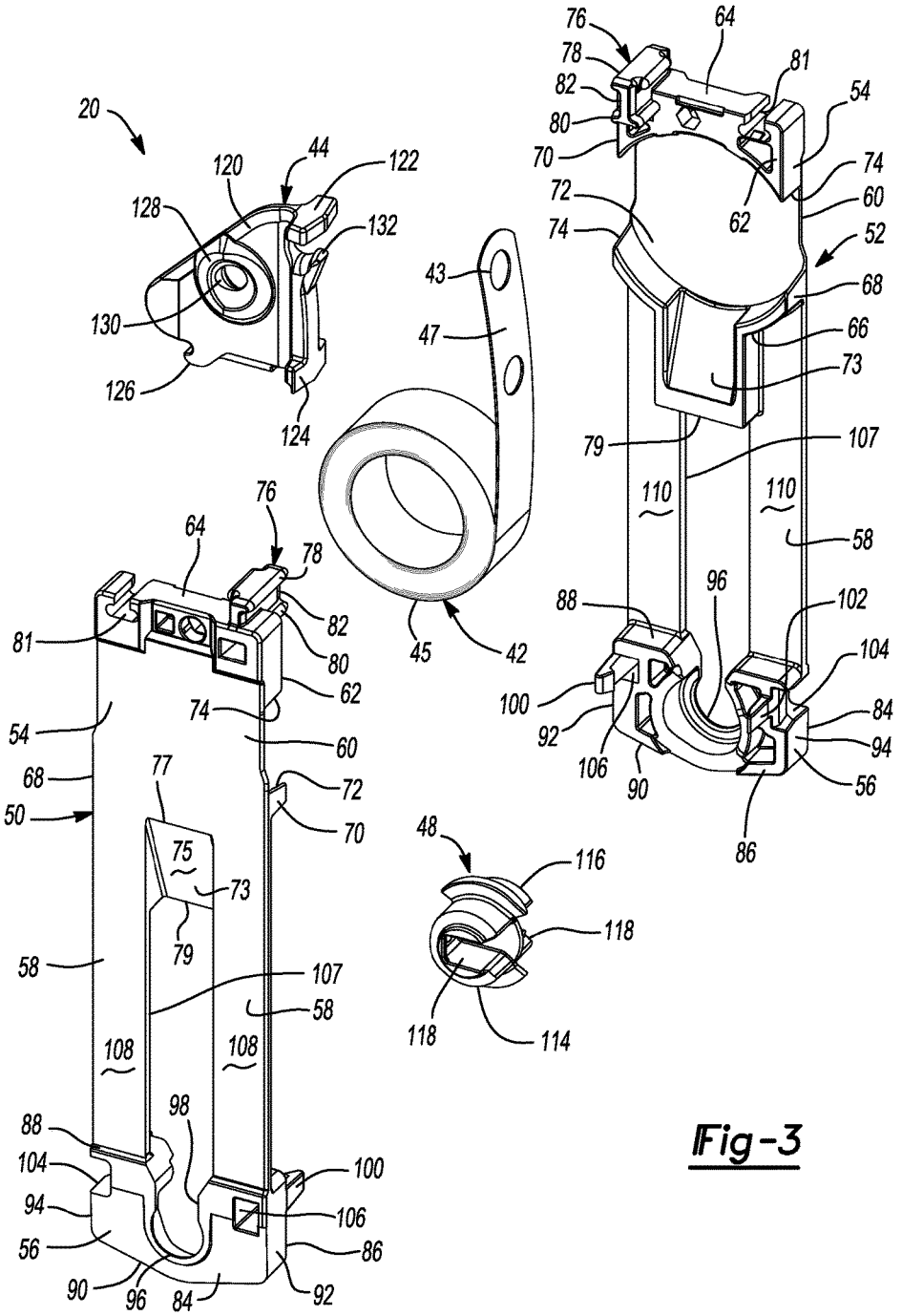
FIG. 3 is an exploded perspective view of the window balance assembly.

Referring now to FIGS. 2 and 3, the carrier 40 may include a body 46 and a cam 48. The body 46 can be molded and/or machined from a polymeric or metallic material, for example, and may include first and second housing portions 50, 52. In some embodiments, the first and second housing portions 50, 52 may be similar or identical components that can engage each other to form a housing for the spring 42 and the cam 48. Each of the first and second housing portions 50, 52 may include an upper body 54, a lower body 56 and a pair of legs 58 extending between the upper and lower bodies 54, 56. It will be appreciated that in some embodiments, the body 46 could be formed from a single piece or in any other suitable manner.

The upper body 54 may include an exterior face 60, an interior face 62, a top end 64, a bottom end 66, a first side 68, and a second side 70. The interior face 62 may include generally cylindrical recesses 72 (FIG. 3). When the first and second housing portions 50, 52 are assembled together, the cylindrical recesses 72 of the first and second housing portions 50, 52 cooperate with each other to form a nest that receives the curled portion 45 of the spring 42. Openings 74 that are in communication with the recess 72 may be formed in the first and second sides 68, 70. The uncurled end 47 of the spring 42 may extend through one of the openings 74 toward the bracket 44. In some embodiments, a ramp 73 having an inclined surface 75 may extend from the bottom end 66 toward the lower body 56 between the legs 58. An upper end 77 of the inclined surface 75 may be adjacent the exterior face 60, and a lower end 79 of the inclined surface 75 may be adjacent the interior face 62.

The upper body 54 may also include a projection 76 and a slot 81 disposed at the top end 64 (FIGS. 2 and 3). The projection 76 may extend from the exterior face 60 beyond the interior face 62 and may include a generally I-shaped cross-section having upper and lower flanges 78, 80 and a body 82 extending therebetween. The slots 81 may be sized and shaped to enable the slots 81 of the first housing portion 50 and the second housing portion 52 to slidably engage the lower flanges 80 of the second housing portion 52 and the first housing portion 50, respectively. The lower flanges 80 may be securely received in the corresponding slots 78 by a snap fit, a press fit, a fastener and/or adhesive, for example, or any other suitable attachment means.

As shown in FIGS. 2 and 3, the lower body 56 may include an exterior face 84, an interior face 86, a top end 88, a bottom end 90, a first side 92, and a second side 94. An aperture 96 may extend through the exterior and interior faces 84, 86 and may rotatably engage the cam 48. A first slot 98 in communication with the aperture 96 may extend through the exterior and interior faces 84, 86 and may extend vertically upward from the aperture 96 through the top end 88.

A first barbed protuberance 100 may be disposed at or proximate to the first side 92 and may extend outward from the interior face 86. A second protuberance 102 may extend outward from the interior face 86 proximate the second side 94. A second slot 104 may be formed in the second side 94 generally opposite the first barbed protuberance 100, and a recess 106 may be formed in the interior face 86 proximate the first side 92 generally opposite the second protuberance 102. In this manner, when the first and second housing portions 50, 52 are assembled together, the first barbed protuberances 100 may engage the second slots 104 and the second protuberances 102 may engage the recesses 106 (as shown in FIG. 2). The engagement between the first barbed protuberances 100 and second slots 104 and between the second protuberances 102 and the recesses 106 may be configured to allow the lower bodies 56 of the first and second housing portions 50, 52 to be movable relative to each other between a first position (corresponding to a tilted position of the lower sash 14) and a second position (corresponding to an upright position of the lower sash 14) without disengaging each other.

The legs 58 may interconnect the upper and lower bodies 54, 56 and may be integrally formed therewith. The legs 58 may be spaced apart from each other and may define a channel 107 therebetween. The channel 107 may be aligned with the ramp 73 of the upper body 54 and with the first slot 98 and aperture 96 of the lower body 56.

Figure 4:
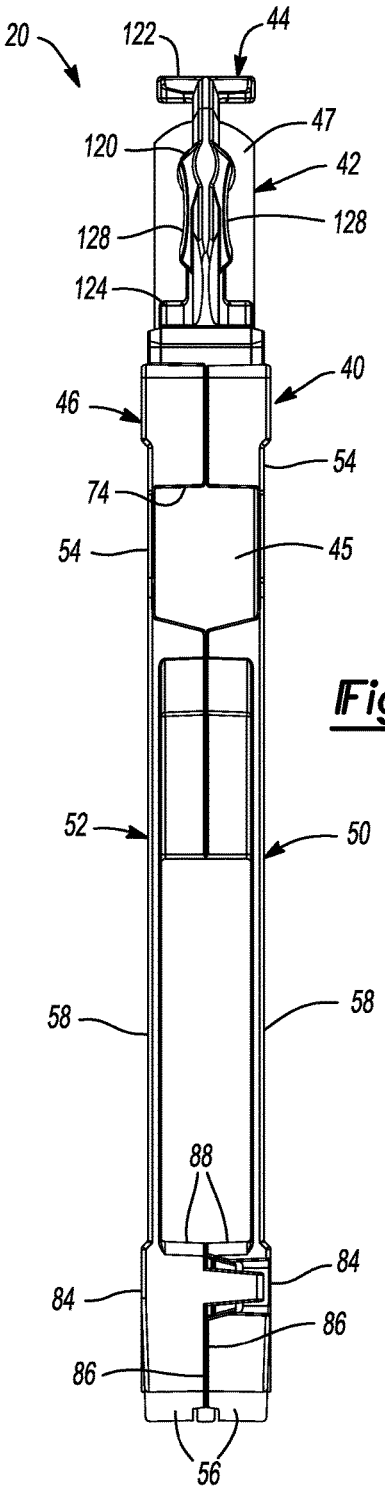
FIG. 4 is a side view of the window balance assembly in a first condition according to the principles of the present disclosure.

The legs 58 may be resiliently flexible members having exterior faces 108 and interior faces 110. The exterior faces 108 of the legs 58 may be substantially flush with the exterior face 60 of the upper body 54. Lower ends 112 of the legs 58 may be disposed at or proximate the exterior face 84 of the lower body 56. The thickness of the legs 58 (i.e., the distance between the exterior and interior faces 108, 110) may be relatively thin compared to the thicknesses of the upper and lower bodies 54, 56. This provides additional flexibility for the legs 58 to resiliently bend and flex between the positions shown in FIGS. 4-7. In some embodiments, the flexibility of the legs 58 may facilitate twisting of the carrier 40 about an axis that extends vertically through the central portions of the carrier 40 and the bracket 44. Because the thickness of the legs 58 is significantly less than the thicknesses of the upper and lower bodies 54, 56, the legs 58 of the first housing portion 50 are spaced apart from the legs 58 of the second housing portion 52 even when the first and second housing portions 50, 52 are assembled together, as shown in FIG. 4.

Figure 5:
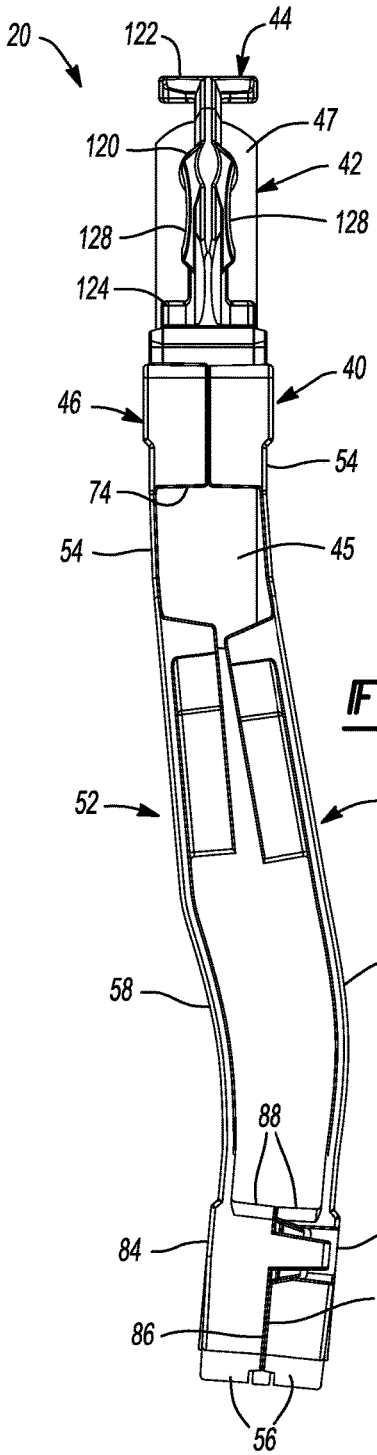
FIG. 5 is a side view of the window balance assembly in a second condition according to the principles of the present disclosure.

As shown in FIG. 5, when the legs 58 are bent relative to the upper bodies 54 in one or more directions, portions of the first and second housing portions 50, 52 may be allowed to shift or move relative to each other. Specifically, lower portions of the upper bodies 54 such as the ramps 73 and the lower portions of the recesses 72 may separate from each other and/or shift or move relative to each other. The relative movement in response to bending the legs 58 may reduce stresses in the carrier 40 and facilitate a greater degree of bending and flexibility of the legs 58.

The cam 48 may be an elliptic cylinder having first and second end faces 114, 116 and a pair of slots 118. One of the slots 118 extends into the first end face 114, and another of the slots 118 extends into the second end face 116. Either of the slots 118 of the cam 48 of each of the window balance assemblies 20 can receive a corresponding one of the pivot bars 22 extending from the lower sash 14. The cam 48 may be rotatable within the aperture 96 between an unlocked position (FIG. 2) corresponding to an upright position of the lower sash 14 and a locked position (FIG. 8) corresponding to a tilted position of the lower sash 14. Rotation of the cam 48 may allow the lower sash 14 to pivot about a longitudinal axis of the pivot bar 22 between the upright position and the tilted position.

Figure 8:
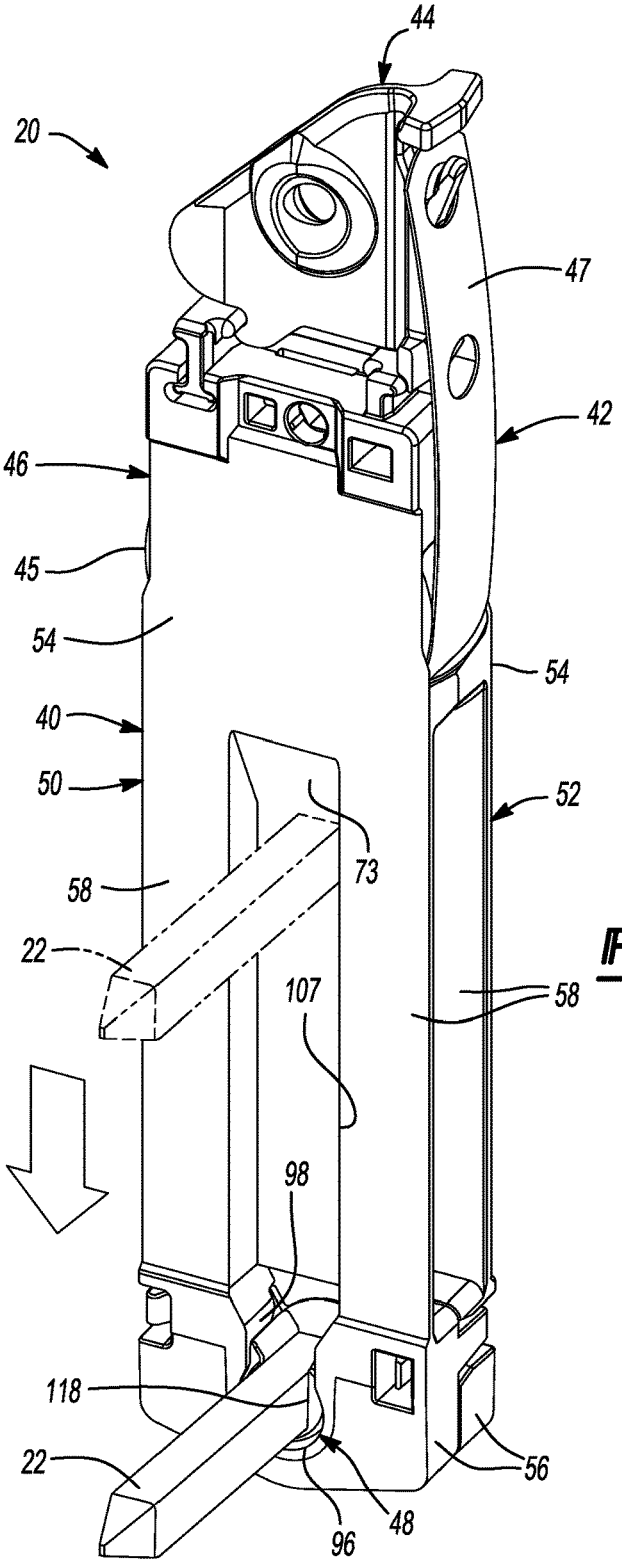
FIG. 8 is a perspective view of the window balance assembly engaging a pivot bar according to the principles of the present disclosure.

When the cam 48 is rotated into the locked position, the elliptical shape of the cam 48 causes the lower bodies 56 of the first and second housing portions 50, 52 of the carrier 40 to move outward away from each other (but without disengaging each other), as described above. With the lower bodies 56 moved outward, the exterior faces 84 of the lower bodies 56 may be forced against third and fourth walls 32, 34 of the jamb channel 26, thereby increasing the friction between the carrier 40 and the jamb channel 26 to lock the carrier 40 relative to the jamb channel 26. As shown in FIG. 8, when the cam 48 is in the locked position, the slot 118 in the cam 48 may be substantially aligned with the channel 107 between the legs 58, the ramp 73 of the upper body 54, the first slot 98 and the aperture 96 of the lower body 56. This alignment allows for "drop-in" installation of the pivot bar into the cam 48 (as shown in FIG. 8) while the carrier 40 is locked in place within the jamb channel 26.

When the cam 48 is in the unlocked position (i.e., oriented such that the slot 118 is oriented horizontally, as shown in FIG. 2), the interior faces 86 of the lower bodies 56 of the carrier 40 may move toward each other (i.e., return to the unlocked or unrestricted position), such that the carrier 40 may be generally unrestricted from moving upward and downward in the window jamb channel 26 as the lower sash 14 moves between the open and closed positions.

The bracket 44 can include any suitable mounting bracket. For example, the bracket 44 may include a mounting bracket of one of the types disclosed in Assignee's commonly owned U.S. patent application Ser. No. 13/576,440, the disclosure of which is hereby incorporated by reference. In the particular embodiment illustrated in FIGS. 2-8, the bracket 44 may be formed from a polymeric material, for example, and may include a body portion 120, a head 122, a base 124, and a tab 126 (FIGS. 2 and 3). The bracket 44 may be substantially symmetric about a plane defining the body portion 120 and extending through the head 122, base 124, and tab 126.

The body portion 120 may include a pair of bosses 128 (FIGS. 4 and 5) disposed on opposite sides of the body portion 120. A mounting aperture 130 may extend through both of the bosses 128. A fastener (not shown) may extend through the mounting aperture 130 and engage the second wall 30 of the jamb channel 26 to secure the bracket 44 to the window jamb 16 when the window balance assembly 20 is fully installed within the window jamb 16. A latch 132 may extend generally upward and outward from the body portion 120 between the head 122 and the base 124. The latch 132 may engage an aperture 43 in the spring 42 (as shown in FIG. 2). The base 124 may extend laterally outward from the body portion 120 and may engage one of the projections 76 of the carrier 40, as shown in FIG. 2.

The tab 126 may extend from body portion 120 and may engage at least a portion of the other one of the projections 76. In some embodiments, the tab 126 may slide and/or snap into and out of engagement with the projection 76 or breakaway from the projection 76 as the fastener is driven into the window jamb 16 to secure the bracket 44 to the second wall 30.

It will be appreciated that the window balance assembly 20 is a non-handed assembly. That is, identical window balance assemblies 20 can be used on either of the right-hand and left-hand sides of the lower sash 14 and with either side of the window balance assembly 20 facing the lower sash 14 (i.e., with either the first housing portion 50 or the second housing portion 52 facing the lower sash 14) without changing the function, structure, configuration or arrangement of the components of the window balance assemblies 20, the window jambs 16 or the sashes 12, 14 or any other component of the window assembly 10.

With reference to FIGS. 4-7, a method of installing the window balance assembly 20 into the window assembly 10 will be described. Installation of the window balance assembly 20 may begin by inserting the window balance assembly 20 into the jamb channel 26. This can be done by inserting the window balance assembly 20 through an open end of the jamb channel 26 before the window jamb 16 is fastened to the window sill 18 and/or header of the window assembly 10, for example. Then, the bracket 44 can be secured to the second wall 30 of the jamb channel 26 and the pivot bar 22 connected to the lower sash 14 can be received into the cam 48, as described above.

Alternatively, the window balance assembly 20 can be inserted into the jamb channel 26 through a cutout 21 in the jamb channel 26 disposed between the upper and lower ends of the window jamb, as shown in FIG. 6. The window balance assembly 20 can be easily inserted into and removed from the jamb channel 26 through the cutout 21 even after the window jamb 16 is installed in the window frame (i.e., after the window jamb 16 is fixed to the window frame header and sill) without disassembling or removing the window jamb 16 from the window assembly 10.

For aesthetic reasons, it may be desirable to minimize or limit a vertical height of the cutout 21. For example, it may be desirable to limit the vertical height of the cutout 21 so that the vertical height of the cutout 21 is less than a vertical height of the window balance assembly 20 or less than a vertical height of the carrier 40. The flexibility of the carrier 40, and particularly, the flexibility of the legs 58 of the carrier 40, allows the window balance assembly 20 to be installed into the jamb channel 26 of a window jamb 16 having a cutout 21 with a vertical height that is less than the vertical height of the window balance assembly 20 or less than the vertical height of the carrier 40.

As shown in FIG. 6, the window balance assembly 20 can be inserted into the relatively small cutout 21 by first inserting the bracket 44 and the upper bodies 54 of the first and second housing portions 50, 52 of the carrier 40 into the jamb channel 26 through the cutout 21. The legs 58 of the carrier 40 can be bent relative to the upper bodies 54 to allow the bracket 44 and the upper bodies 54 to be fully received in the jamb channel 26. Then, the upper bodies 54 and the bracket 44 can be slid upward in the jamb channel 26. Then, the legs 58 can be resiliently returned back to their original position and can be received into the jamb channel 26 through the cutout 21 along with the lower bodies 56. It will be appreciated that the bracket 44 could be disengaged from the carrier 40 prior to inserting the window balance assembly 20 into the jamb channel 26 to enable the window balance assembly 20 to be received into the jamb channel 26 through an even smaller cutout 21. It will also be appreciated that the window balance assembly 20 could be inserted into the jamb channel 26 by first inserting the lower bodies 56 through the cutout 21 and then sliding the lower bodies 56 downward in the jamb channel 26 so that the upper bodies 54 and bracket 44 can be subsequently received through the cutout 21.

Figure 9:
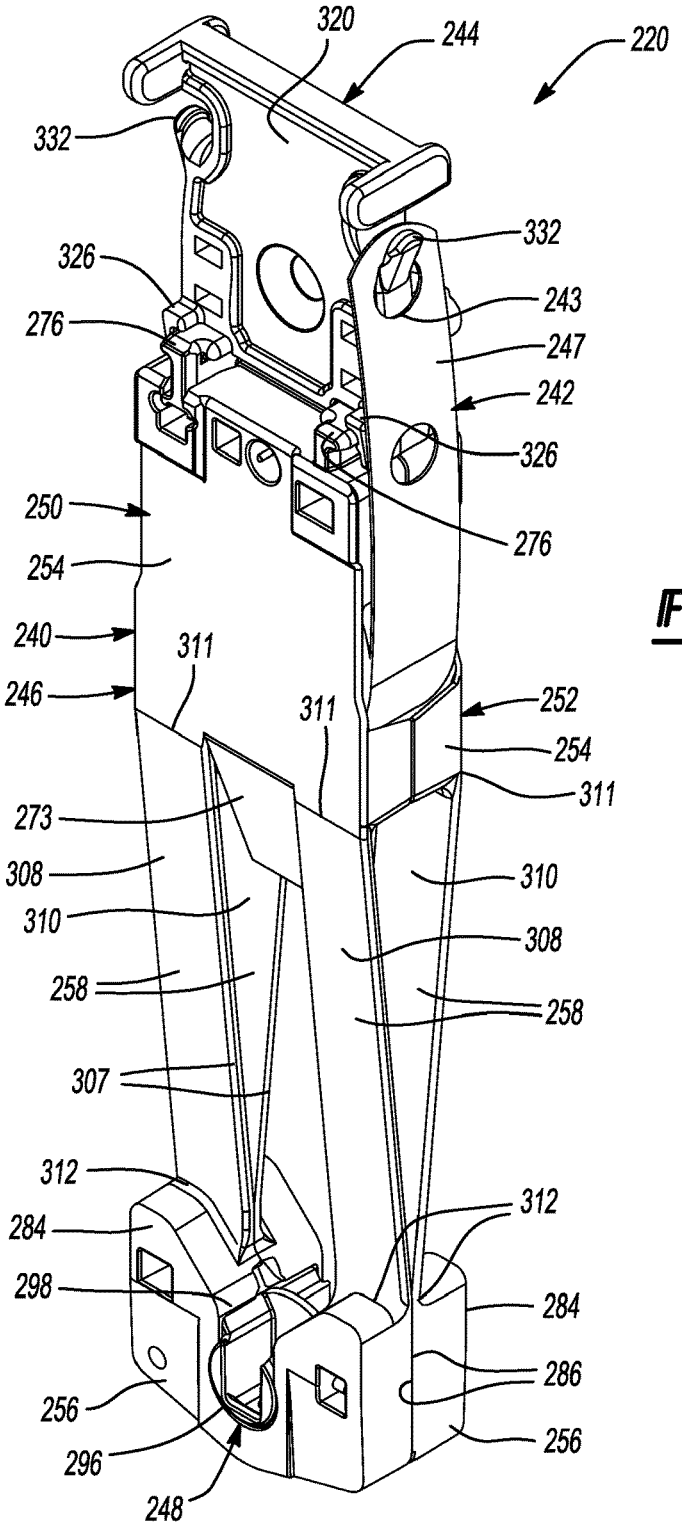
FIG. 9 is a perspective view of another window balance assembly according to the principles of the present disclosure.
Figure 10:
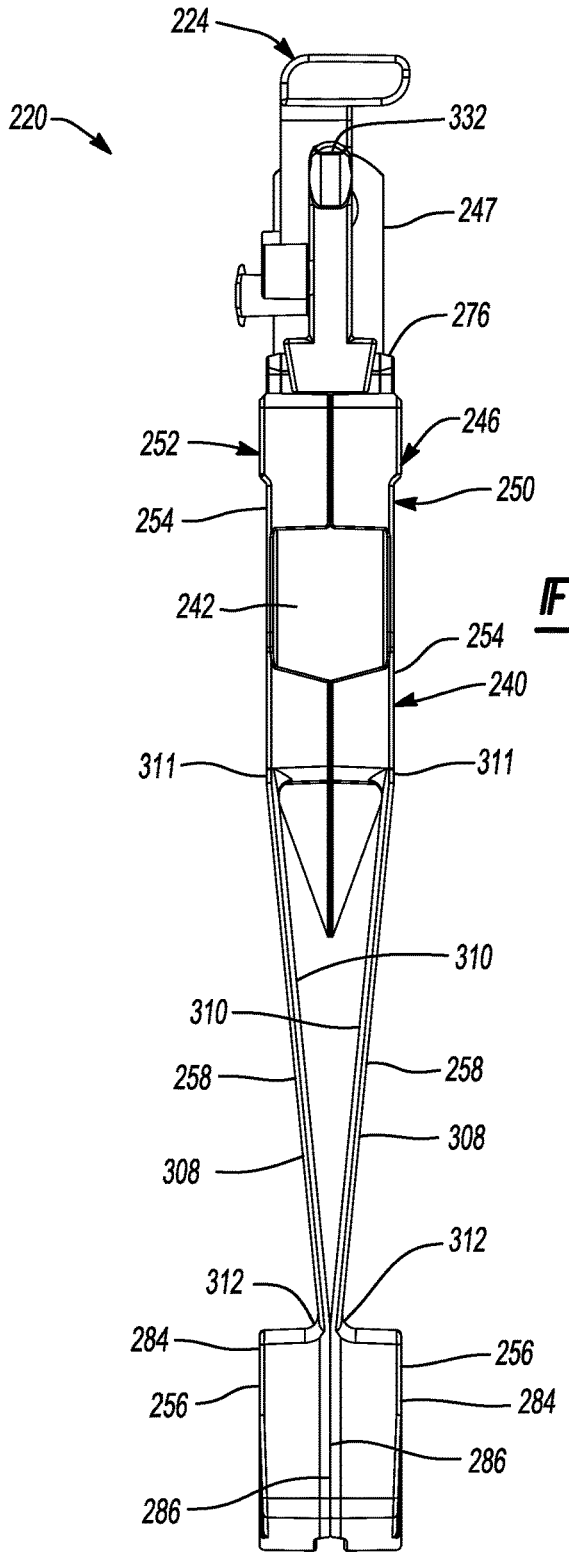
FIG. 10 is a side view of the window balance assembly of FIG. 9.
Figure 11:
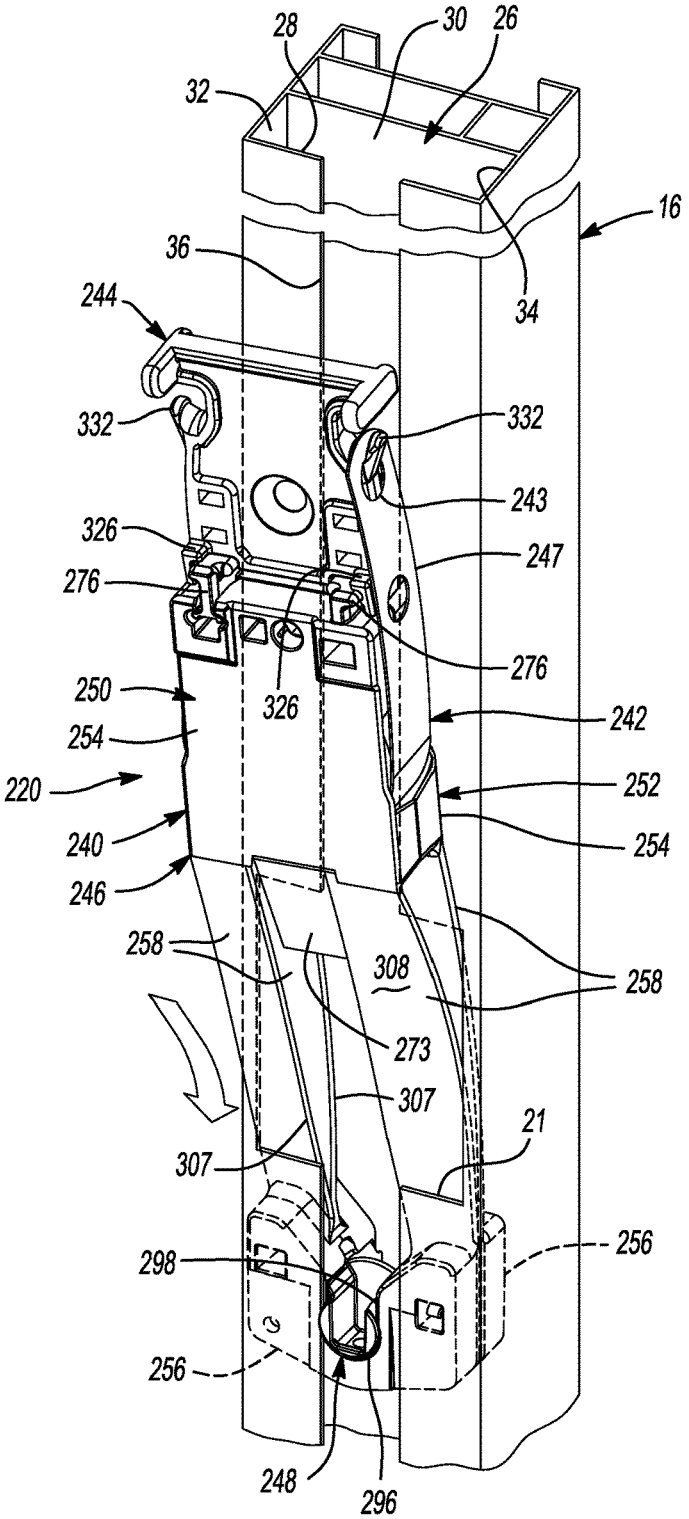
FIG. 11 is a perspective view of the window balance assembly of FIG. 9 being installed into a window jamb channel according to the principles of the present disclosure.

With reference to FIGS. 9-11, another window balance assembly 220 is provided. The structure, function and installation of the window balance assembly 220 can be substantially similar to that of the window balance assembly 20, apart from any exceptions described herein and/or shown in the figures. Therefore, similar structures, functions and operations will not be described again in detail.

Two or more of the window balance assemblies 220 may be incorporated into the window assembly 10 (FIG. 1) in place of or in addition to the window balance assemblies 20 to urge the upper and/or lower sashes 12, 14 upward toward the header. Similar to the window balance assemblies 20, each of the window balance assemblies 220 may include a carrier 240, a spring 242 and a bracket 244.

The carrier 240 can be generally similar to the carrier 40 and may include a body 246 and a cam 248. The cam 248 can be identical to the cam 48 described above. The body 246 can include identical first and second housing portions 250, 252 that can engage each other to form a housing for the spring 242 and the cam 248. Each of the first and second housing portions 250, 252 may include an upper body 254, a lower body 256 and a pair of legs 258 extending between the upper and lower bodies 254, 256. The upper and lower bodies 254, 256 may be substantially identical to the upper and lower bodies 54, 56, and therefore, will not be described again in detail.

The legs 258 may interconnect the upper and lower bodies 254, 256 and may be integrally formed therewith. The legs 258 of the first housing portion 250 may be spaced apart from each other and may partially define a channel 307 therebetween. The legs 258 of the second housing portion 252 may be spaced apart from each other and may partially define the channel 307 therebetween. The channel 307 may be aligned with a ramp 273 of the upper body 254 and with a slot 298 and aperture 296 of the lower body 256. The legs 258 of the first housing portion 250 may be in contact with or in close proximity to the legs 258 of the second housing portion 252.

Like the legs 58, the legs 258 may be relatively thin, resiliently flexible members having exterior faces 308 and interior faces 310. Upper ends 311 of the legs 258 may extend from the upper body 254 at or proximate the exterior face 60 of the upper body 254. Lower ends 312 of the legs 258 may be disposed at or proximate an interior face 286 of the lower body 256. Accordingly, when the first and second housing portions 250, 252 are assembled together, the legs 258 of the first and second housing portions 250, 252 cooperate to form a V-shape, as shown in FIG. 10. It will be appreciated that the lower ends 312 of the legs 258 could be disposed at any location between exterior and interior faces 284, 286 of the lower body 256.

The bracket 244 may include a body 320 and a pair of tabs 326. A pair of latches 332 may extend from opposite edges of the body 320. Either of the latches 332 can be used to engage an aperture 243 in an uncurled portion 247 of the spring 242. The tabs 326 may extend from body 320 and may engage projections 276 of the carrier 240. In some embodiments, the tabs 326 may slide and/or snap into and out of engagement with the projections 276 or breakaway from the projection 276 as the bracket 244 is fixed to the second wall 30 during installation of the window balance assembly 220. The bracket 244 could be attached to the second wall 30 by any suitable method. It will be appreciated that the window balance assembly 220 could include the bracket 44 or any other suitable type of mounting bracket in place of the bracket 244.

Figure 12:
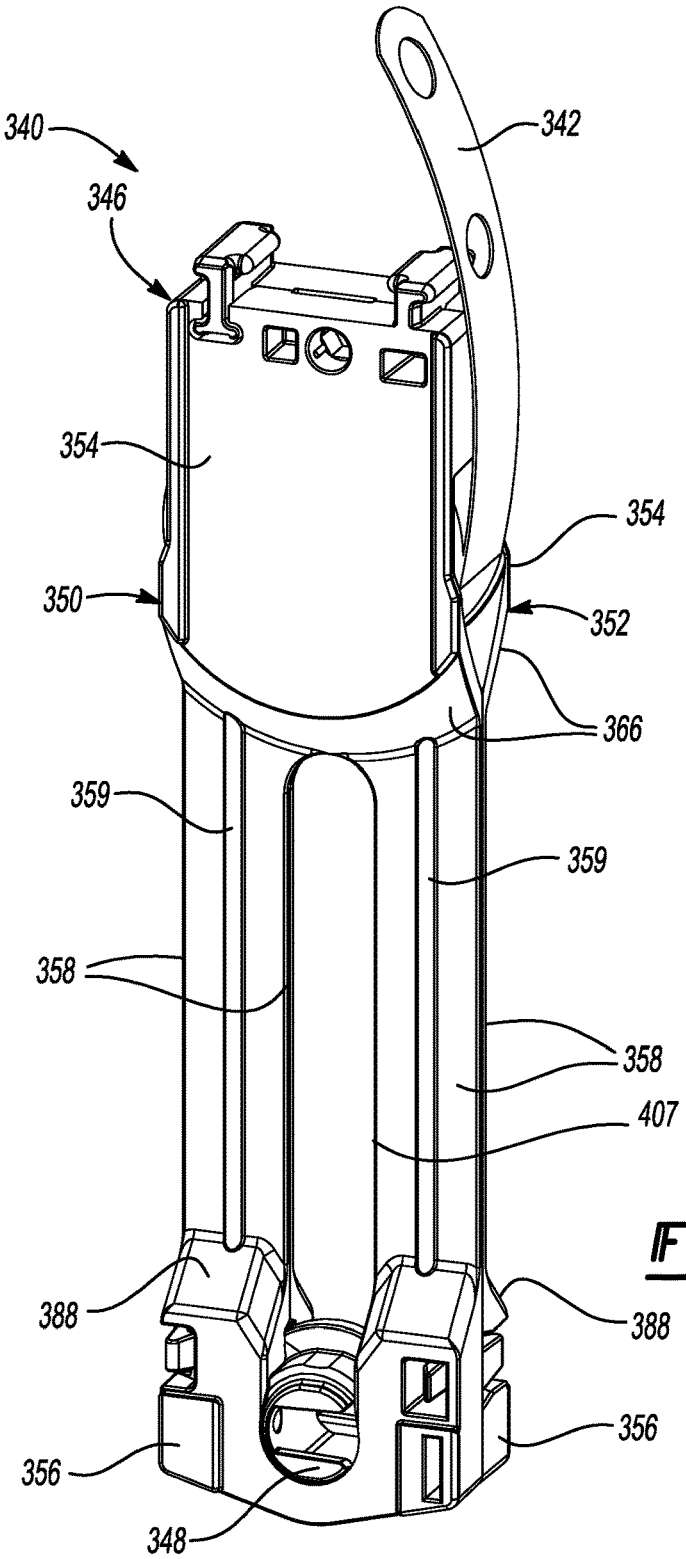
FIG. 12 is a perspective view of another carrier for a window balance assembly according to the principles of the present disclosure.

With reference to FIG. 12, another carrier 340 is provided. The structure, function and installation of the carrier 340 can be substantially similar to that of the carrier 240, apart from any exceptions described herein and/or shown in the figures. Therefore, similar structures, functions and operations will not be described again in detail. The carrier 340 can be incorporated into either of the window balance assemblies 20, 220, for example.

Like the carriers 40, 240, the carrier 340 may include a body 346 and a cam 348. The cam 348 can be identical to the cam 48 described above. The body 346 can include identical first and second housing portions 350, 352 that can engage each other to form a housing for a spring 342 and the cam 348. Each of the first and second housing portions 350, 352 may include an upper body 354, a lower body 356 and a pair of legs 358 extending between the upper and lower bodies 354, 356.

The upper and lower bodies 354, 356 may be substantially similar to the upper and lower bodies 54, 56, and therefore, similar features will not be described again in detail. A bottom end 366 of the upper body 354 may be curved and may be tapered so that the bottom ends 366 of the first and second housing portions 350, 352 extend toward each other and may contact each other. A top end 388 of the lower body 356 may be tapered so that the top ends 388 of the first and second housing portions 350, 352 extend toward each other and may contact each other.

The legs 358 may interconnect the upper and lower bodies 354, 356 and may be integrally formed therewith. The legs 358 may extend between the lower end of the tapered bottom end 366 of the upper body 354 and an upper end of the tapered top end 388 of the lower body 356. The legs 358 of the first housing portion 350 may be spaced apart from each other and may partially define a channel 407 therebetween. The legs 358 of the second housing portion 352 may be spaced apart from each other and may partially define the channel 407 therebetween. The legs 358 of the first housing portion 350 may be in contact with or in close proximity to the legs 358 of the second housing portion 352.

Like the legs 58, 258, the legs 358 may be relatively thin, resiliently flexible members. Each of the legs 358 may include an elongated rib 359 that may span the length of its corresponding leg 358. The ribs 359 may provide additional strength and/or stiffness, but may still allow the legs 358 to resiliently flex to allow the carrier 340 to be inserted into a relatively small cutout 21, as described above.

While the carriers 40, 240, 340 are described above as including first and second housing portions each including a pair of flexible legs 58, 258, 358, it will be appreciated that the carriers 40, 240, 340 could include any number of legs 58, 258, 358 and could be formed from any number of pieces. For example, in some embodiments, the carrier could include a single leg or single flexible, central portion. Alternatively, the carrier could include first and second housing portions each including a single leg or single flexible, central portion.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A carrier for a window balance assembly comprising:

an upper body portion engaging a spring member;

a lower body portion rotatably supporting a cam; and an elongated central portion extending between and joining the upper body portion and the lower body portion, the elongated central portion extending along a longitudinal axis, wherein the elongated central portion comprises a vertical channel that is aligned with and in communication with a slot in the cam when the cam is in a first rotational position such that a pivot bar can slide vertically in the channel and into the slot;

wherein the elongated central portion is resiliently bendable to allow a first movement of the lower body portion relative to the upper body portion toward and away from each other along the longitudinal axis;

wherein the elongated central portion is substantially flexible in at least one direction which is perpendicular to the longitudinal axis and is substantially inflexible in at least another direction which is perpendicular to the longitudinal axis to restrict a second movement of the lower body portion realative to the upper body portion; and wherein the elongated central portion is resiliently twistable about the longitudinal axis to allow third movement of the upper body portion relative to the lower body portion.

2. The carrier of claim 1, wherein the elongated central portion comprises two legs that each include an exterior face that is substantially flush with an exterior face of the upper body portion.

3. The carrier of claim 1, wherein the elongated central portion comprises two legs each of which includes an elongated rib extending between the upper and lower body portions.

4. The carrier of claim 1, wherein the upper body portion includes a first exterior face and the elongated central portion comprises two legs, wherein each of the legs includes a second exterior face that is angled relative to the first exterior face.

5. The carrier of claim 1, wherein the upper body portion, the lower body portion and the elongated central portion are integrally formed as a first unitary body; and further comprising a second unitary body including a second upper body portion, a second lower body portion and a second elongated central portion, wherein the first and second unitary bodies cooperate to form a housing for the spring member and the cam;

wherein a first portion of the upper body portion of the first unitary body is movable relative to a second portion of the second unitary body in response to bending of the elongated central portions; and wherein a position of the lower body portion of the first unitary body relative to the second lower body portion of the second unitary body is unaffected by bending of the elongated central portions.

6. The carrier of claim 1, wherein the elongated central portion includes four elongated legs.

7. A window balance assembly comprising the carrier of claim 1, wherein the spring member comprises a curl spring having a curled portion and an uncurled end portion; and wherein the curled portion is received by the carrier and a mounting bracket engages the uncurled end portion of the curl spring.

8. A carrier for a window balance assembly comprising:

a body extending along a first axis of the carrier and comprising a first housing portion, the first housing portion comprising:

a first upper body portion, a first lower body portion and at least two parallel, first flexible legs extending between and connecting the first upper body portion with the first lower body portion;

wherein the first upper body portion comprises a first exterior face;

wherein the first lower body portion comprises a first interior face and a first aperture extending through the first lower body portion;

wherein the at least two first legs are spaced apart from one another along a second axis that is substantially perpendicular to the first axis to define a channel between the at least two first legs and between the first upper body portion and the first lower body portion;

wherein upper ends of the at least two first legs connect with the first upper body portion proximate to the first exterior face of the first upper body portion;

wherein lower ends of the at least two first legs connect with the first lower body portion proximate to the first interior face of the first lower body portion; and a cam comprising a slot that is rotatably disposed in the first aperture.

9. The carrier for a window balance assembly of claim 8 further comprising:

a second housing portion comprising:

a second upper body portion, a second lower body portion and at least two parallel, second flexible legs extending between and connecting the second upper body portion with the second lower body portion;

wherein the second upper body portion comprises a second exterior face;

wherein the second lower body portion comprises a second interior face and a second aperture extending through the second lower body portion;

wherein the at least two second legs are spaced apart from one another along the second axis;

wherein upper ends of the at least two second legs connect with the second upper body portion proximate to the second exterior face of the second upper body portion;

wherein lower ends of the at least two second legs connect with the second lower body portion proximate to the second interior face of the second lower body portion;

wherein the first housing portion and the second housing portion each form approximately one-half of the body;

wherein the at least two second legs are spaced apart from one another along the second axis to define a second channel between the at least two second legs and between the second upper body portion and the second lower body portion together; and wherein the cam is rotatably disposed in the first aperture and the second aperture.

10. A window balance assembly comprising the carrier of claim 9 and a curl spring having a curled portion and an uncurled end portion; and wherein the curled portion is received by the carrier and a mounting bracket engages the uncurled end portion of the curl spring.

11. A window balance assembly comprising:

a carrier;

a curl spring comprising a curled portion and an uncurled portion, wherein the curled portion is supported by the carrier; and a mounting bracket engaging the uncurled portion of the curl spring;

wherein the carrier comprises:

a body extending along a first axis of the carrier and comprising a first housing portion and a second housing portion, wherein each of the first housing portion and the second housing portion comprises:

an upper body, a lower body and at least two parallel, flexible legs extending between and connecting the upper body with the lower body;

wherein said upper body comprises an exterior face;

wherein said lower body comprises an interior face and an aperture extending through the lower body;

wherein the at least two legs are spaced apart from one another along a second axis that is substantially perpendicular to the first axis to define a channel between the at least two legs and between the upper and lower bodies;

wherein upper ends of the legs connect with said upper body proximate to the exterior face of said upper body;

wherein lower ends of the legs connect with said lower body proximate to the interior face of said lower body; and a cam comprising a slot that is rotatably disposed in the aperture.

12. The window balance assembly of claim 11 wherein the mounting bracket comprises a main body portion and a pair of latches on opposite sides of the main body portion; and wherein at least one of the latches engages an aperture in the uncurled portion of the curl spring.

13. The window balance assembly of claim 11, wherein:

the mounting bracket comprises tabs that releasably engage with projections on the carrier.

14. The window balance assembly of claim 11, wherein:

the mounting bracket comprises tabs that engage with projections on the carrier;

wherein the tabs are adapted to break away from the projections.

15. The window balance assembly of claim 11 wherein the mounting bracket comprises a main body portion and a plurality of tabs that, respectively, engage a plurality of projections on the carrier.

16. The window balance assembly of claim 11, further comprising:

a fastener for attaching the mounting bracket to a window jamb.

17. The window balance assembly of claim 11 wherein the legs of the first housing portion and the legs of the second housing portion cooperate to form a V-shape when viewed along the second axis.

18. The window balance assembly of claim 11, wherein the first and second housing portions cooperate to receive the curled portion of the curl spring.

19. The window balance assembly of claim 11 wherein the mounting bracket comprises at least one latch that engages an aperture in the uncurled portion of the curl spring; and wherein the mounting bracket comprises at least one tab that engages a projection on the carrier.

20. The window balance assembly of claim 11, wherein said legs of the first and second housing portions are integrally formed, respectively, with the upper and lower bodies of the first and second housing portions.

21. The window balance assembly of claim 11, wherein each said upper body comprises a ramp.

* * * * *